US008857072B1

(12) United States Patent
Cocker et al.

(10) Patent No.: US 8,857,072 B1
(45) Date of Patent: Oct. 14, 2014

(54) MITTEN AND BOOT DRYER FOR USE WITH A RESIDENTIAL FURNACE

(76) Inventors: Mark Cocker, Brooklyn Center, MN (US); Cathy Cocker, Brooklyn Center, MN (US)

( * ) Notice: Subject to any disclaimer, the term of this patent is extended or adjusted under 35 U.S.C. 154(b) by 611 days.

(21) Appl. No.: 13/196,018

(22) Filed: Aug. 2, 2011

(51) Int. Cl.
*F26B 25/08* (2006.01)

(52) U.S. Cl.
USPC ..... 34/104; 34/103; 34/106; 34/107; 34/239

(58) Field of Classification Search
CPC ..... A43D 3/1491; F26B 25/08; F26B 9/003; F26B 21/006; F26B 21/00; F26B 25/14; F26B 25/18; F26B 25/185; A47L 23/18; A47L 23/20; A47L 23/205; F16L 37/004; F16L 37/00
USPC ..... 34/104, 106, 107, 103, 239
See application file for complete search history.

(56) References Cited

U.S. PATENT DOCUMENTS

| | | | | | |
|---|---|---|---|---|---|
| 2,465,362 | A | * | 3/1949 | Elliott | 34/104 |
| 3,645,009 | A | | 2/1972 | Ketchum | |
| 4,085,519 | A | * | 4/1978 | Masika | 34/104 |
| 4,136,464 | A | * | 1/1979 | Hay | 34/104 |
| 4,596,078 | A | | 6/1986 | McCartney | |
| D293,021 | S | | 12/1987 | McCarteny | |
| 5,058,289 | A | * | 10/1991 | Guindon | 34/104 |
| 5,199,188 | A | * | 4/1993 | Franz | 34/105 |
| 5,287,636 | A | * | 2/1994 | Lafleur et al. | 34/104 |
| 5,289,642 | A | * | 3/1994 | Sloan | 34/104 |
| D347,094 | S | | 5/1994 | Christensen, Jr. | |
| D349,788 | S | | 8/1994 | Laferriere et al. | |
| 5,406,717 | A | * | 4/1995 | Dofka | 34/104 |
| 5,632,099 | A | | 5/1997 | Seifert et al. | |
| 5,692,316 | A | * | 12/1997 | Antal | 34/106 |
| 5,946,814 | A | * | 9/1999 | Farrant | 34/103 |
| 6,327,792 | B1 | * | 12/2001 | Hebert | 34/104 |
| 6,839,982 | B1 | * | 1/2005 | Hoover | 34/90 |
| 2005/0050754 | A1 | * | 3/2005 | Deblois | 34/218 |
| 2005/0097768 | A1 | | 5/2005 | Burns et al. | |
| 2007/0000143 | A1 | * | 1/2007 | Rosseau et al. | 34/104 |
| 2012/0013117 | A1 | * | 1/2012 | Bernshtein | 285/9.1 |

* cited by examiner

*Primary Examiner* — Kenneth Rinehart
*Assistant Examiner* — Sharla Magana
(74) *Attorney, Agent, or Firm* — Kyle A. Fletcher, Esq.

(57) ABSTRACT

The mitten and boot dryer for use with a residential furnace includes a vent plate made of a ferrous material, which is mounted either one a forced air residential furnace or down line therefrom. The vent plate features a plurality of holes upon which a vent may be attached via an angled base support. The angled base support features a magnet embedded therein, which attaches itself onto the hole of the vent plate, and can rotate there about. Alternatively, the angled base support may feature a winged end that slides into a winged hole on the vent plate, and is rotated therein so as to lock into the vent plate. The vent has a cap on a farthest distal end and features a plurality of holes along the length. The angled base support includes a friction hinge to enable rotation of the vent with respect to the vent plate. The vents are ideally oriented at angles to enable a boot or mitten to rest thereon. The vent plate may include a plurality of holes not covered by a vent, which enables heated air to dry out the exterior of the boot, mitten, or object hung thereon. The vents may include telescoping bodies that can extend and retract in length.

15 Claims, 9 Drawing Sheets

MITTEN AND BOOT DRYER FOR USE WITH A RESIDENTIAL FURNACE

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of dryer devices, more specifically, a device that mounts to an output of or down line with a furnace and of which dries out boots, and/or mittens.

B. Discussion of the Prior Art

As a preliminary note, it should be stated that there is an ample amount of prior art that deals with drying devices. As will be discussed immediately below, no prior art discloses a dryer device that mounts onto a residential forced air furnace or down line on a horizontal or vertical air register, which further comprises of a vent plate having a plurality of holes located thereon and on which at least one vent attaches thereon; wherein each vent is composed of an angled base support that attaches to a vent line, which has a cap at a farthest distal end; wherein the angled base support includes a friction hinge to enable rotation of the vent with respect to the vent plate; wherein the angled base support attaches to the vent plate via a magnet that is embedded within the angled base support or a winged end that slides into one of the holes of the vent plate and which is then rotated in order to lock in place; wherein the vents have a plurality of holes and extend vertically and upon which mittens and/or boots rest thereon in order to introduce heated air therein and to dry out said objects; and wherein the vents may have telescoping bodies that can extend and retract.

The Burns, Sr. et al. Patent Application Publication (U.S. Pub. No. 2005/0097768) discloses an apparatus for drying gloves and boots, which includes a pipe, a fan, a plurality, of first tubes connected to the pipe, and a plurality of second tubes connected to the first tubes. However, the apparatus is not directed to use with an existing forced air residential furnace.

The Hay Patent (U.S. Pat. No. 4,136,464) discloses a boot drying apparatus that utilizes a hollow plenum chamber having a lowermost open mouth portion for resting upon a hot air discharge grill disposed in the surface of a floor or a room. However, the apparatus does not feature a vent plate that mounts vertically upon a furnace or down line from said furnace and of which vents extend therefrom to hang items thereon.

The Farrant Patent (U.S. Pat. No. 5,946,814) discloses a dryer for drying accessories that includes a support beam and a plurality of tubular members with air delivery passages extending therethrough, and wherein the support beam is adapted for positioning and aligning with a wall register. Again, the accessory is designed for use with an existing register and is not able to be installed onto an existing furnace, or include vents that can adjust via angled base supports.

The Masika Patent (U.S. Pat. No. 4,085,519) discloses a drying device for drying gloves, boots, shoes, etc. in association with a household forced air furnace. However, the drying device does not include an angled base support that can orient the vents in a near vertical orientation via angled base supports that attach via magnets.

The McCartney Patent (U.S. Pat. No. 4,596,078) discloses a boot and glove drying device that is used in conjunction with a floor mounted heating outlet. However, the device is for use with a floor mounted register and not a register that is either horizontal or vertical.

The Seifert et al. Patent (U.S. Pat. No. 5,632,099) discloses an apparatus for drying footwear. However, the apparatus does not feature vents that are angularly oriented with respect to a vent plate such that the device can be either mounted on a register or a furnace at a horizontal or vertical orientation.

The Ketchum Patent (U.S. Pat. No. 3,645,009) discloses a boot and glove drying device. However, the device is not mounted on a vertical or horizontal register or side of a furnace.

The Christensen, Jr. Patent (U.S. Pat. No. Des. 347,094) illustrates an ornamental design for a combined glove and boot dryer, which does not depict a vent plate and a plurality of vents extending therefrom at an angle via angled base support.

While the above-described devices fulfill their respective and particular objects and requirements, they do not describe a dryer device that mounts onto a residential forced air furnace or down line on a horizontal or vertical air register, which further comprises of a vent plate having a plurality of holes located thereon and on which at least one vent attaches thereon; wherein each vent is composed of an angled base support that attaches to a vent line, which has a cap at a farthest distal end; wherein the angled base support includes a friction hinge to enable rotation of the vent with respect to the vent plate; wherein the angled base support attaches to the vent plate via a magnet that is embedded within the angled base support or a winged end that slides into one of the holes of the vent plate and which is then rotated in order to lock in place; wherein the vents have a plurality of holes and extend vertically and upon which mittens and/or boots rest thereon in order to introduce heated air therein and to dry out said objects; and wherein the vents may have telescoping bodies that can extend and retract. In this regard, the mitten and boot dryer for use with a residential furnace departs from the conventional concepts and designs of the prior art.

SUMMARY OF THE INVENTION

The mitten and boot dryer for use with a residential furnace includes a vent plate made of a ferrous material, which is mounted either one a forced air residential furnace or down line therefrom. The vent plate features a plurality of holes upon which a vent may be attached via an angled base support. The angled base support features a magnet embedded therein, which attaches itself onto the hole of the vent plate, and can rotate there about. Alternatively, the angled base support may feature a winged end that slides into a winged hole on the vent plate, and is rotated therein so as to lock into the vent plate. The vent has a cap on a farthest distal end and features a plurality of holes along the length. The angled base support includes a friction hinge to enable rotation of the vent with respect to the vent plate. The vents are ideally oriented at angles to enable a boot or mitten to rest thereon. The vent plate may include a plurality of holes not covered by a vent, which enables heated air to dry out the exterior of the boot, mitten, or object hung thereon. The vents may include telescoping bodies that can extend and retract in length.

An object of the invention is to provide a dryer device that mounts onto a furnace or down line from a furnace that offers a plurality of vents to hang objects thereon, and which will dry said objects both internally and externally.

A further object of the invention is to provide a plurality of vents that have an angled base support that has a magnet embedded therein or a winged end for attachment of the vent to a hole of the vent plate.

A further object of the invention is to provide an angled base support that can rotate about the hole in the vent plate, which enables the vent to be vertically oriented in order to hang objects thereon.

An even further object of the invention is to provide a friction hinge on the angled base support, which enables rotation of the vent with respect to the vent plate.

A further object of the invention is to include caps on each vent that have a single hole for releasing heated air.

A further object of the invention is to provide an alternative vent that has a telescoping body for adjusting the length of the vent.

These together with additional objects, features and advantages of the mitten and boot dryer for use with a residential furnace will be readily apparent to those of ordinary skill in the art upon reading the following detailed description of presently preferred, but nonetheless illustrative, embodiments of the mitten and boot dryer for use with a residential furnace when taken in conjunction with the accompanying drawings.

In this respect, before explaining the current embodiments of the mitten and boot dryer for use with a residential furnace in detail, it is to be understood that the mitten and boot dryer for use with a residential furnace is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mitten and boot dryer for use with a residential furnace.

It is therefore important that the claims be regarded as including such equivalent construction insofar as they do not depart from the spirit and scope of the mitten and boot dryer for use with a residential furnace. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
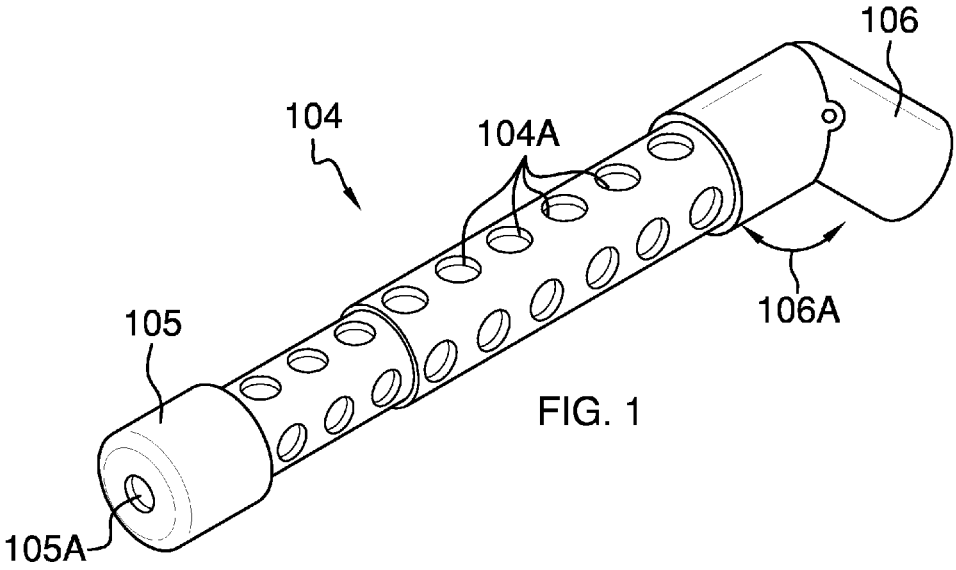
FIG. 1 illustrates a front, isometric view of a vent fully assembled with the cap on the farthest distal end, and the angled base support at an angle with respect to the vent, and detailing the plurality of holes along the length of the vent.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. A mitten and boot dryer for use with a residential furnace 100 (hereinafter invention) includes a vent plate 101 that is made of a ferrous material and includes a plurality of vent holes 102 arranged in a predefined manner thereon. The vent plate 101 attaches onto a horizontal or vertical opening 129, which may include a furnace 130 or a register 131. The vent plate 101 attaches onto said opening via attaching means 103 comprising bolts, screws, nails, glue, or rivets.

A plurality of vents 104 are composed of a cylindrically shaped pipe that has a plurality of holes 104A adorning the length of the vents 104. A cap 105 is placed on a farthest distal end 104B of the vents 104 and includes a cap hole 105A.

An angled base support 106 is mounted to a first end 104C. The angled base support 106 has a friction hinge 106A near a middle of said angled base support 106, which enables rotation of the vent 104 when attached to the vent plate 101. It is important to note that the friction hinge 106A is simply a hinge that does not freely rotate, but rather requires the use of an applied force to rotate the angled base support 106. The friction hinge 106A can support an object on the distal end 104B of the vent 104 without rotating. The angled base support 106, like the vent 104, is of hollow construction and features an inlet 106B.

Referring to FIGS. 1, 2, 3, 4A-4C, and 5, a magnet 107 is embedded in the inlet 106B of the angled base support 106. The magnet 107 enables the vent 104, the cap 105, and the angled base support 106 to attach to one of the vent holes 102 of the vent plate 101. The magnet 107 is a small ring that enables the inlet 106B of the angled base support 106 to be unobstructed. Since the vent plate 101 is made of a ferrous material, the magnet 107 is attracted thereto. The use of the magnet 107 to attach the vent 104 to the vent plate 101 insures that the vent 104 and the angled base support 106 can rotate about the vent hole 102 (see FIG. 4).

The cap 105, the vent 104, and the angled base support 106 may be made of a material comprising a metal, plastic, wood, or carbon fiber composite. However, it shall be noted that it would be desirable to use a light material so that the effectiveness of the magnet 107 is not compromised.

The invention 100 is mounted onto the opening 129 such that heated air 150 may pass through the vent holes 102 of the vent plate 101, and if applicable up through the angled base support 106 and into the vent 104 and if possible out through the opening 105A of the cap 105. The vents 104 and the corresponding cap 105 are used to hang items thereon, such as gloves 160, mittens 161, or boots 162.

It shall be important to note that the vent holes 102 of the vent plate 101 may form a pattern. If a pattern of vent holes 102 is formed, then it may be desirable to align the vents along vent holes 102 that are at a highest elevation with respect to all of the vent holes 102, which will leave remaining vent holes 102 that emit the heated air 150 to rise and dry an exterior surface of the gloves 160, mittens 161, or boots 162.

It shall be further noted that it is desirable to orient the vents 104 in a vertical orientation or at an orientation that streamlines the movement of the heated air 150 upwards.

Figure 6:
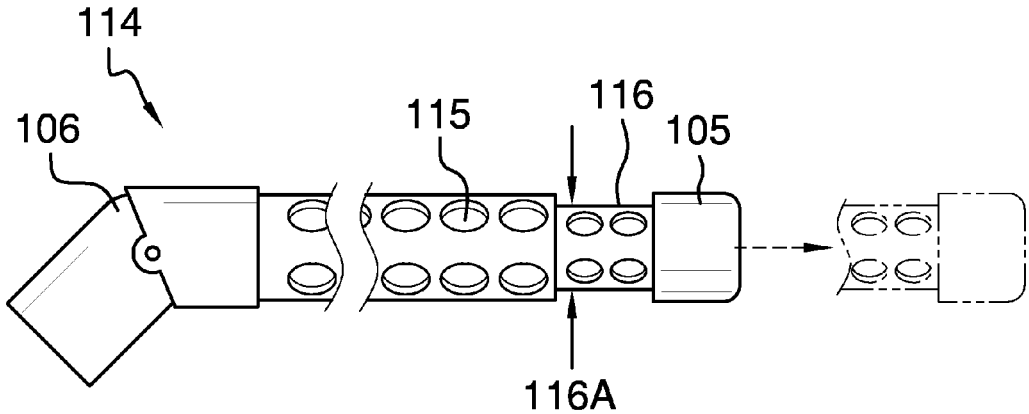
FIG. 6 illustrates a side view of an alternative embodiment of a vent that has a telescoping body that can extend and retract in length.
Figure 7:
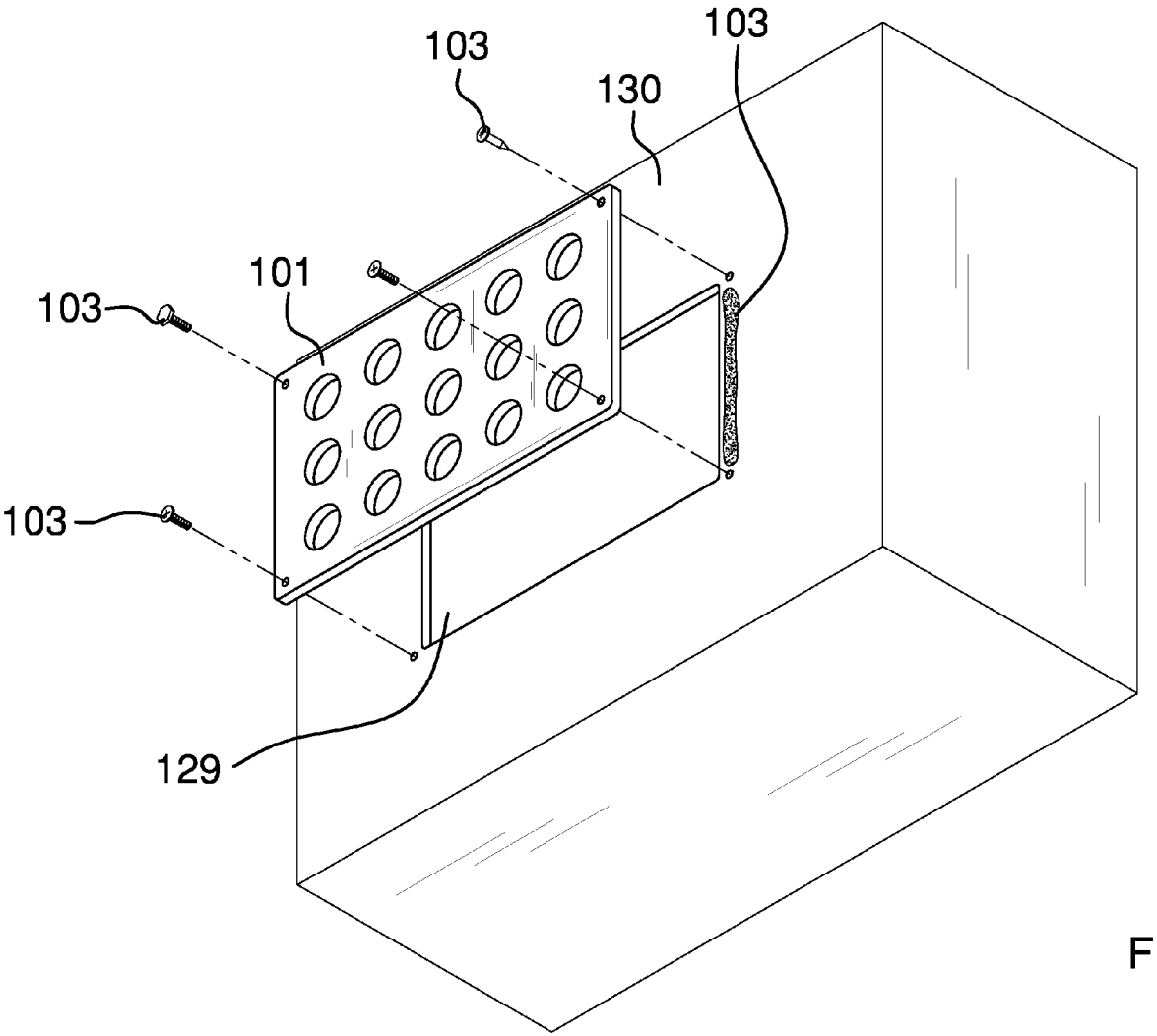
FIG. 7 illustrates a view of the mitten and boot dryer for use with a residential furnace aligned adjacent an opening in said furnace wherein attaching means are provided.
Figure 8:
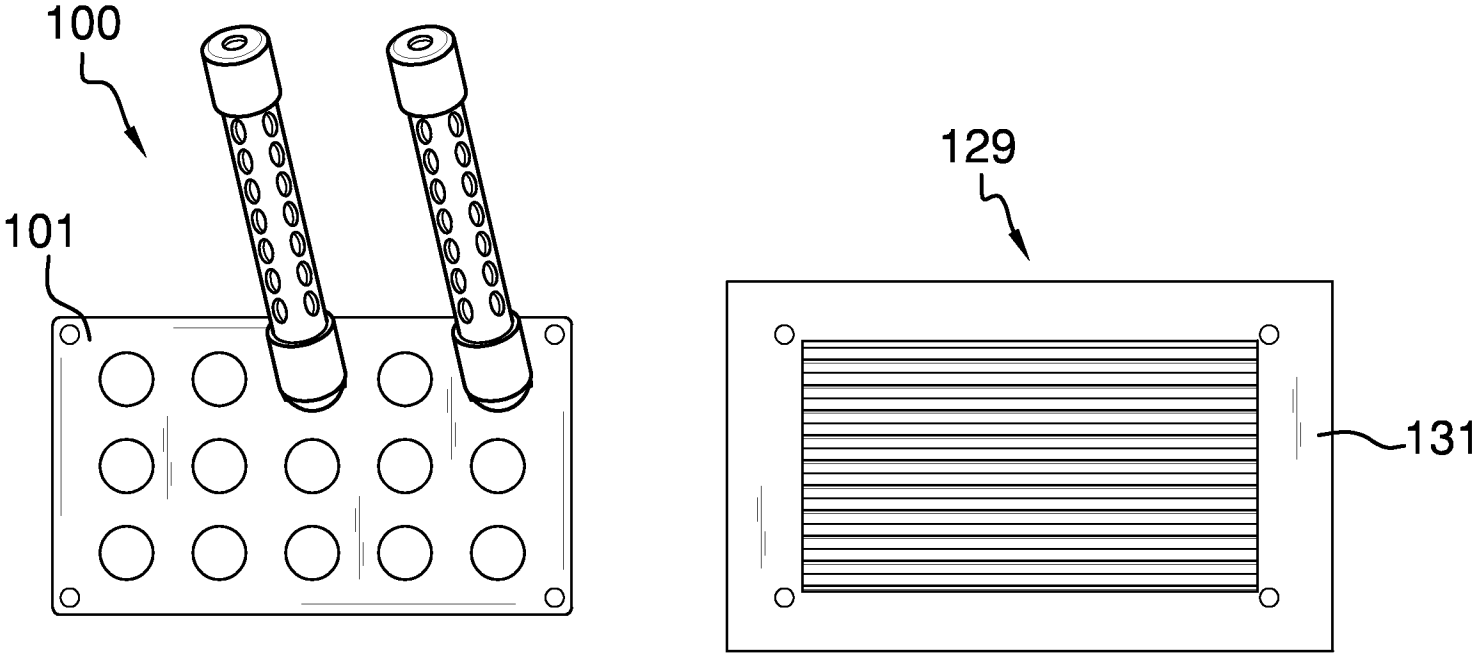
FIG. 8 illustrates a view of the mitten and boot dryer for use with a residential furnace aligned adjacent a register that is in fluid communication with the furnace.

Referring to FIG. 6, an alternative embodiment of the vent 114 features a telescoping feature comprised of the angled base support 106, the magnet 107, and cap 105 as previously discussed. However, the vent 114 is further comprised of a first member 115 that is affixed to the angled base support 106. A second member 116 has an outer diameter 116A less than an inner diameter of the first member 115 such that the second member 116 telescopes with respect to the first member 115.

Figure 1A:
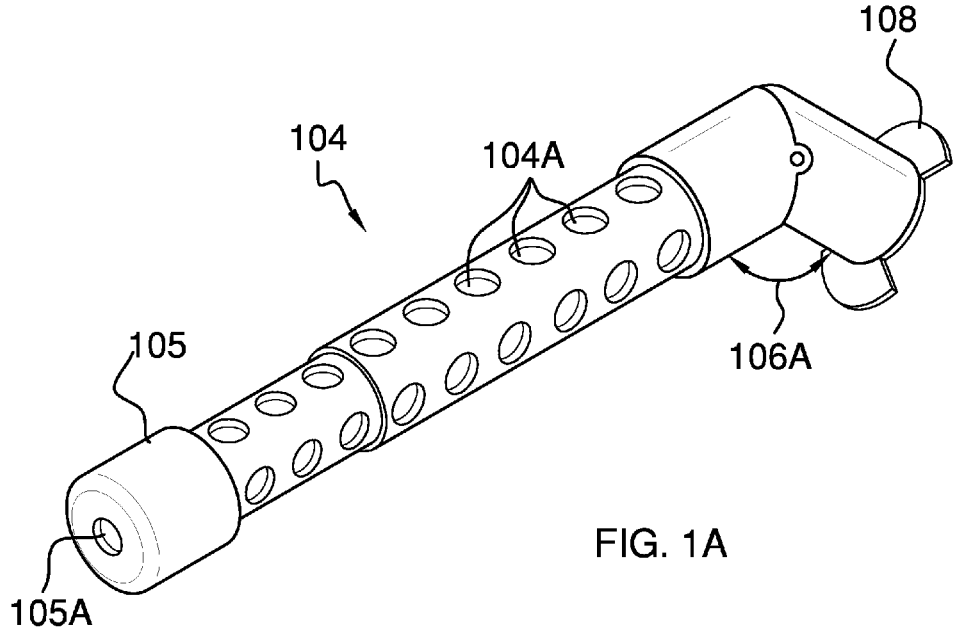
FIG. 1A illustrates a front, isometric view of an alternative embodiment of the vent where in the angled base support features a winged end that supports the vent on a vent plate.
Figure 2:
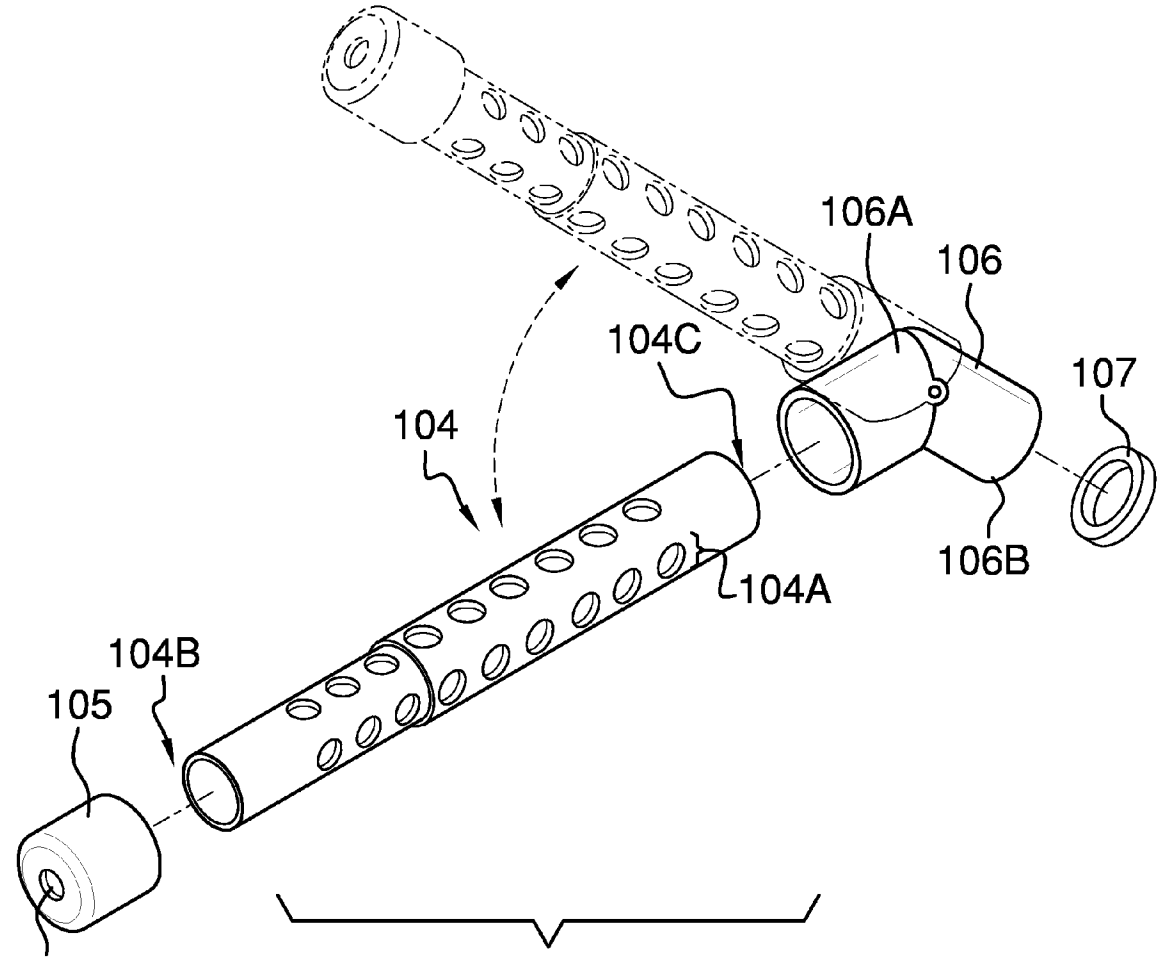
FIG. 2 illustrates an isometric view of the vent in an exploded state and detailing the magnet embedded within the angled base support, a rotational arrow indicates movement of the vent with respect to the angled base support via the friction hinge.
Figure 3:
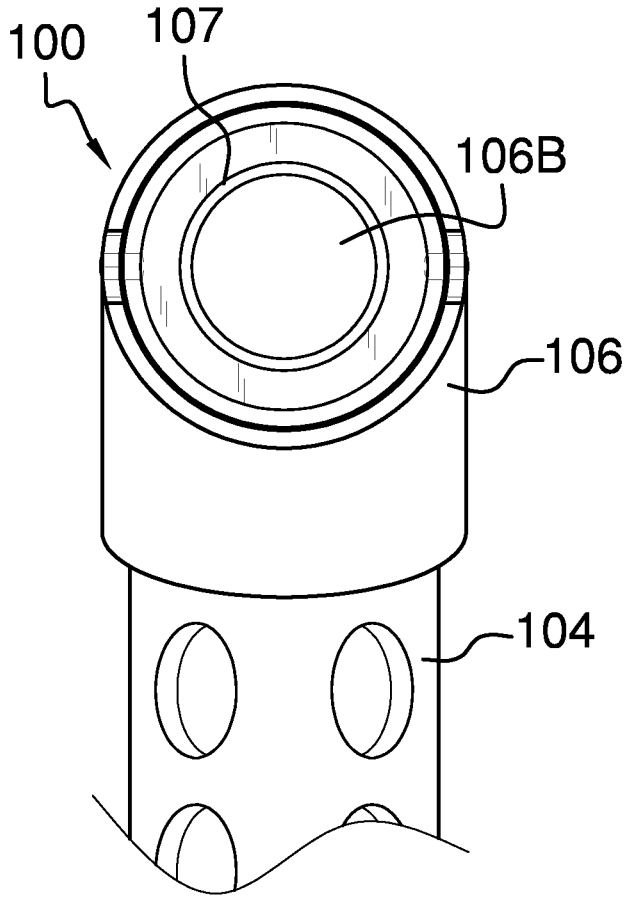
FIG. 3 illustrates a bottom view of the vent and detailing the magnet embedded within the angled base support such that the magnet enables attachment upon one of the holes of the vent plate.
Figure 4B:
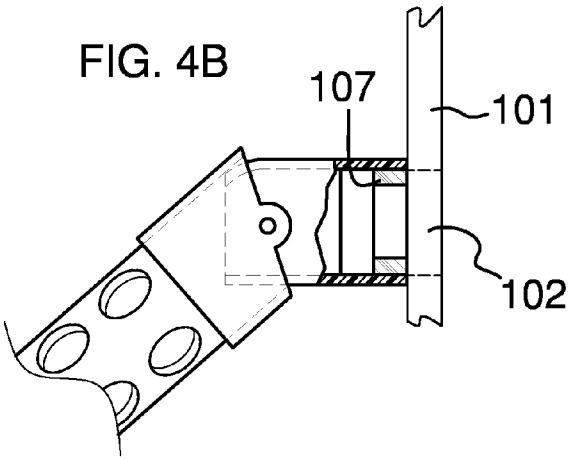
FIG. 4B illustrates a cross sectional view of a vent and angled base support aligned adjacent a hole and attached to the vent plate.
Figure 4C:
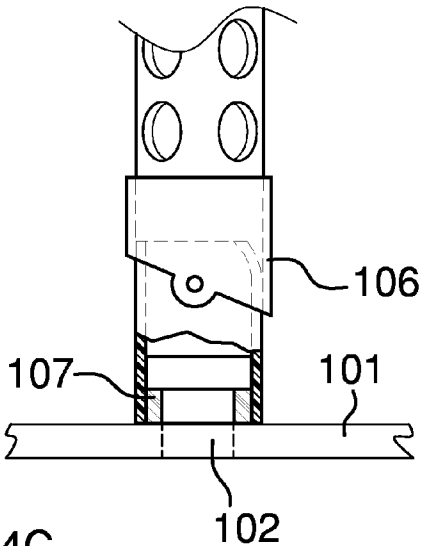
FIG. 4C illustrates a cross sectional view of the vent and angled base support in a perpendicular orientation with respect to the vent plate.
Figure 4A:
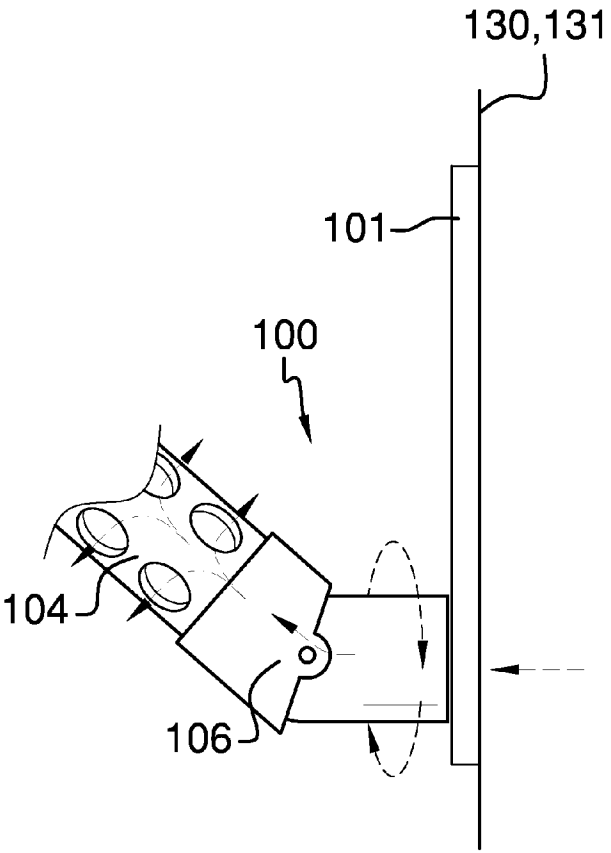
FIG. 4A illustrates a side view of a vent attached to one of the holes of the vent plate and with a rotational arrow depicting rotation of the angled base support and vent thereabout.
Figure 5:
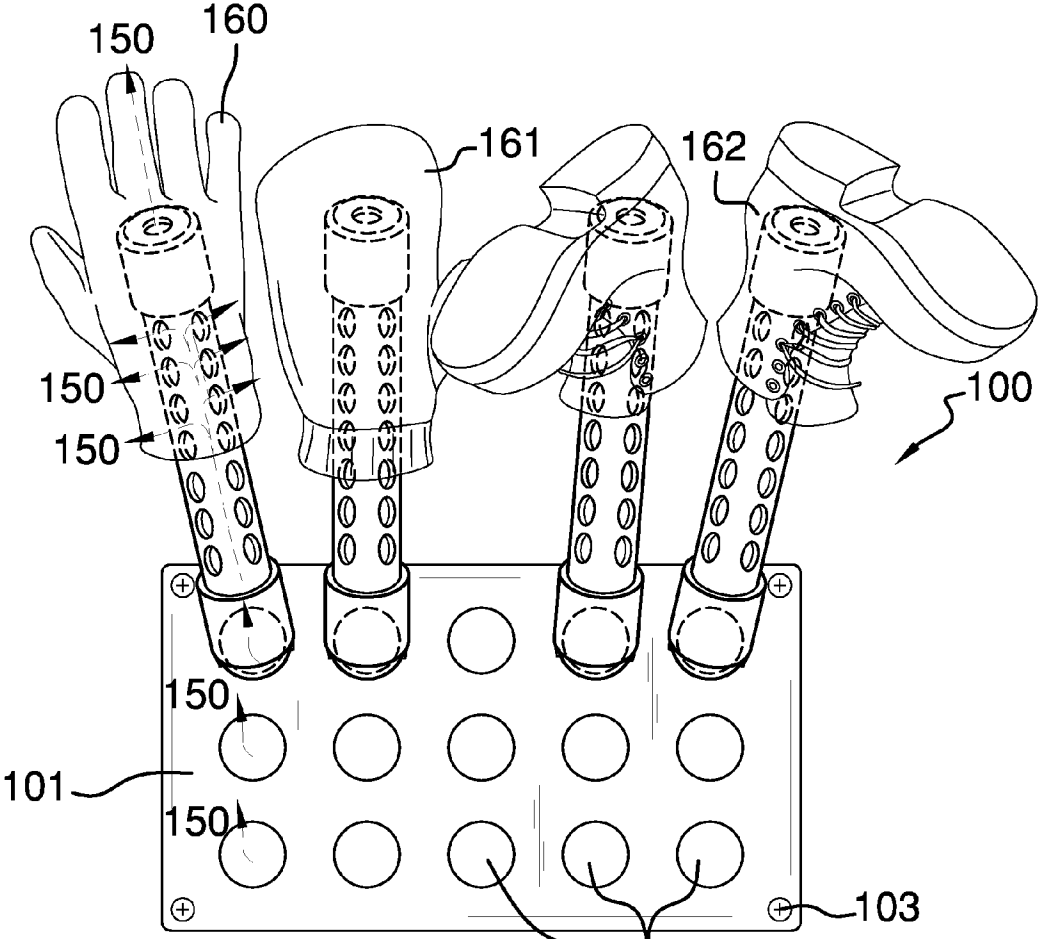
FIG. 5 illustrates a front view of the mitten and boot dryer for use with a residential furnace with four vents attached to different holes on the vent plate, and with the vents oriented generally upwards such that mittens/boots/objects can be hung therefrom.
Figure 5A:
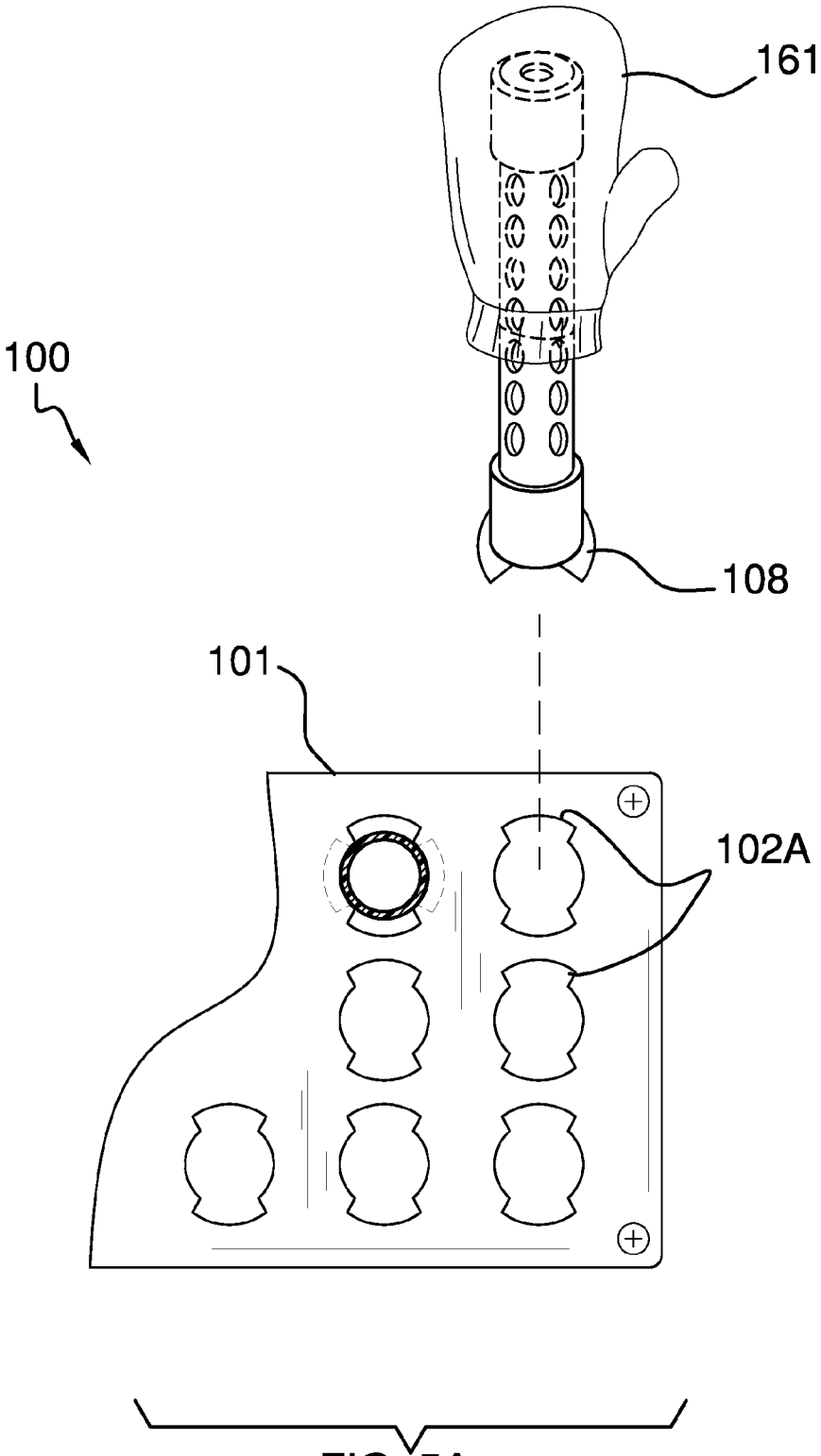
FIG. 5A illustrates a front view of a vent having a mitten hung thereon in which the vent is aligned adjacent a hole of the vent plate having winged openings to enable attachment of the vent to the vent plate.

Referring to FIGS. 1A and 5A, the angled base support 106 may include a winged end 108 instead of the magnet 107. The winged end 108 is used to secure both the angled base support 106 and the vent 104 onto the vent plate 101. However, the vent plate 101 features winged vent holes 102A, which enables one of the winged ends 108 to slide therein, and subsequently rotate to lock the vent 104 in place with respect to the vent plate 101. It is important to note that the winged vent holes 102A have a shape that is consistent with the outer shape of the winged ends 108.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mitten and boot dryer for use with a residential furnace, further comprising:

a vent plate having a plurality of vent holes thereon;

wherein the vent plate is attached via an attaching member to an opening on a furnace or a register down line from said furnace;

wherein a plurality of vents are each comprised of a cylindrically shaped pipe having holes located thereon having a cap at a farthest distal end and an angled base support attached to a first end;

wherein the angled base support attaches onto one of the vent holes and transfers heated air into said vent;

wherein the vent and cap can be used to hang an object thereon in order to dry out an interior of said object;

wherein vent holes without vents attached thereon can transmit heated air and dry out an exterior surface of said object;

wherein the vent plate has the plurality of vent holes in a pattern; and wherein the vents shall be aligned along vent holes that are at a highest elevation with respect to all of the vent holes, which will leave remaining vent holes that emit the heated air to rise and dry an exterior surface of the object.

2. The mitten and boot dryer for use with a residential furnace as described in claim 1 wherein the angled base supports each have a magnet embedded at an inlet; wherein the vent plate is made of a ferrous material such that the angled base support attaches thereon; wherein the angled base support can rotate about the respective vent hole.

3. The mitten and boot dryer for use with a residential furnace as described in claim 1 wherein the angled base supports each have a winged end that can slide into one of a plurality of winged vent holes having the same shape.

4. The mitten and boot dryer for use with a residential furnace as described in claim 1 wherein the attaching member comprising bolts, screws, nails, glue, or rivets.

5. The mitten and boot dryer for use with a residential furnace as described in claim 1 wherein the cap includes a single cap hole.

6. The mitten and boot dryer for use with a residential furnace as described in claim 1 wherein the cap, the vent, and the angled base support may be made of a material comprising a metal, plastic, wood, or carbon fiber composite.

7. The mitten and boot dryer for use with a residential furnace as described in claim 1 wherein the objects comprise gloves, mittens, or boots.

8. The mitten and boot dryer for use with a residential furnace as described in claim 1 wherein the vents include a telescoping feature comprised of a first member that is affixed to the angled base support; wherein a second member has an outer diameter less than an inner diameter of the first member such that the second member telescopes with respect to the first member.

9. A mitten and boot dryer for use with a residential furnace, further comprising:

a vent plate having a plurality of vent holes thereon;

wherein the vent plate is attached via attaching member to an opening on a furnace or a register down line from said furnace;

wherein a plurality of vents are each comprised of a cylindrically shaped pipe having holes located thereon having a cap at a farthest distal end and an angled base support attached to a first end;

wherein the angled base support attaches onto one of the vent holes and transfers heated air into said vent;

wherein the vent and cap can be used to hang an object thereon in order to dry out an interior of said object;

wherein the cap includes a single cap hole;

wherein vent holes without vents attached thereon can transmit heated air and dry out an exterior surface of said object;

wherein the angled base support has a friction hinge about a middle of said angled base support; wherein friction hinge enables rotation of the vent with respect to the vent plate;

wherein the angled base support is of hollow construction;

wherein the vent plate has the plurality of vent holes in a pattern; and wherein the vents shall be aligned along vent holes that are at a highest elevation with respect to all of the vent holes, which will leave remaining vent holes that emit the heated air to rise and dry an exterior surface of the object.

10. The mitten and boot dryer for use with a residential furnace as described in claim 9 wherein the attaching member comprising bolts, screws, nails, glue, or rivets.

11. The mitten and boot dryer for use with a residential furnace as described in claim 9 wherein the angled base supports each have a magnet embedded at an inlet; wherein the vent plate is made of a ferrous material such that the angled base support attaches thereon; wherein the angled base support can rotate about the respective vent hole.

12. The mitten and boot dryer for use with a residential furnace as described in claim 9 wherein the angled base supports each have a winged end that can slide into one of a plurality of winged vent holes having the same shape.

13. The mitten and boot dryer for use with a residential furnace as described in claim 9 wherein the cap, the vent, and the angled base support may be made of a material comprising a metal, plastic, wood, or carbon fiber composite.

14. The mitten and boot dryer for use with a residential furnace as described in claim 9 wherein the objects comprise gloves, mittens, or boots.

15. The mitten and boot dryer for use with a residential furnace as described in claim 9 wherein the vents include a telescoping feature comprised of a first member that is affixed to the angled base support; wherein a second member has an outer diameter less than an inner diameter of the first member such that the second member telescopes with respect to the first member.

* * * * *